US010753093B2

(12) United States Patent
Charlton

(10) Patent No.: US 10,753,093 B2
(45) Date of Patent: Aug. 25, 2020

(54) INSULATED FIREPROOF CONCRETE FORM SYSTEM

(71) Applicant: Daniel Charlton, Chelsea (CA)

(72) Inventor: Daniel Charlton, Chelsea (CA)

( * ) Notice: Subject to any disclaimer, the term of this patent is extended or adjusted under 35 U.S.C. 154(b) by 0 days.

(21) Appl. No.: 16/445,588

(22) Filed: Jun. 19, 2019

(65) Prior Publication Data

US 2019/0390459 A1 Dec. 26, 2019

Related U.S. Application Data

(60) Provisional application No. 62/687,343, filed on Jun. 20, 2018.

(51) Int. Cl.

| | |
|---|---|
| ***E04C 2/04*** | (2006.01) |
| ***E04B 1/78*** | (2006.01) |
| ***E04B 1/04*** | (2006.01) |

(52) U.S. Cl.

CPC ..... *E04C 2/049* (2013.01); *E04B 1/04* (2013.01); *E04B 1/78* (2013.01)

(58) Field of Classification Search

CPC ..... E04C 2/049; E04C 1/10; E04C 2002/045; E04B 1/04; E04B 1/78; E04B 2/32; E04B 1/4178; E04B 2/30; E04B 2002/0206

See application file for complete search history.

(56) References Cited

U.S. PATENT DOCUMENTS

| | | | | | |
|---|---|---|---|---|---|
| 2,047,890 | A * | 7/1936 | Sanford | E04B 2/30 | 52/596 |
| 2,321,449 | A * | 6/1943 | Armao | B28B 23/028 | 52/515 |
| 2,341,757 | A * | 2/1944 | Brenneman | E04B 2/30 | 52/562 |
| 2,647,392 | A * | 8/1953 | Wilson | E04B 2/30 | 52/563 |
| 4,557,094 | A * | 12/1985 | Beliveau | E04B 2/18 | 52/405.4 |
| 5,107,648 | A * | 4/1992 | Roby | E04B 2/8647 | 52/309.12 |
| 6,321,497 | B1 * | 11/2001 | Cormier | E04B 2/8635 | 52/425 |
| 6,532,710 | B2 | 3/2003 | Terry | | |
| 7,765,765 | B1 * | 8/2010 | Perronne | E02D 27/02 | 52/309.11 |
| 8,037,652 | B2 * | 10/2011 | Marshall | E02D 27/02 | 52/309.11 |
| 8,171,688 | B2 * | 5/2012 | Junker | E04C 2/12 | 52/233 |
| 8,820,024 | B1 * | 9/2014 | Abdullah | E04B 2/08 | 52/561 |
| 9,745,739 | B2 | 8/2017 | Riepe | | |
| 2001/0045070 | A1 | 11/2001 | Hunt | | |

(Continued)

*Primary Examiner* — Brian D Mattei

(74) *Attorney, Agent, or Firm* — Boudwin Intellectual Property; Daniel Boudwin

(57) ABSTRACT

An insulated fireproof concrete form system. The system includes a pair of autoclaved aerated concrete blocks oriented parallel to each other. A pair of insulating blocks are disposed on a pair of internal surfaces of the pair of autoclaved aerated concrete blocks. The pair of insulating blocks are horizontally staggered relative to the pair of autoclaved aerated concrete blocks. A plurality of rods connects the pair of autoclaved aerated concrete blocks.

6 Claims, 2 Drawing Sheets

(56) References Cited

U.S. PATENT DOCUMENTS

| | | | | |
|---|---|---|---|---|
| 2002/0043038 | A1* | 4/2002 | Cerrato | E04B 1/703 52/604 |
| 2004/0035081 | A1 | 2/2004 | Carrabba et al. | |
| 2004/0177579 | A1* | 9/2004 | Tremelling | E04B 2/8617 52/426 |
| 2010/0229489 | A1 | 9/2010 | Riepe | |
| 2010/0236179 | A1* | 9/2010 | Kim | E04B 2/44 52/578 |
| 2013/0255177 | A1* | 10/2013 | VonDross | E04C 1/40 52/598 |
| 2014/0150361 | A1* | 6/2014 | Castonguay | E04B 2/26 52/309.4 |
| 2015/0191909 | A1* | 7/2015 | Linares, III | E04C 2/288 52/309.11 |
| 2015/0308113 | A1* | 10/2015 | Blum | E04C 1/40 52/404.4 |
| 2018/0195281 | A1* | 7/2018 | Tanami | E04C 3/29 |

* cited by examiner

INSULATED FIREPROOF CONCRETE FORM SYSTEM

CROSS REFERENCE TO RELATED APPLICATIONS

This application claims the benefit of U.S. Provisional Application No. 62/687,343 filed on Jun. 20, 2018. The above identified patent application is herein incorporated by reference in its entirety to provide continuity of disclosure.

BACKGROUND OF THE INVENTION

The present invention relates to an insulated fireproof concrete form system. Specifically, a system having structural orientation such that the blocks can be easily arranged in a manner providing enhanced stability and usability.

Installation of existing insulated concrete forms made from expanded polystyrene can be quick to install, but the wall may require extensive bracing in order to support the wall and to prevent the forms from moving while concrete is being poured. Further, since insulated forms are made of expanded polystyrene, they are extremely flammable. Furthermore, by law, they must be covered with non-flammable material to inhibit burning. Because of these properties, there is a defined need for an insulated fireproof concrete form system.

Autoclaved aerated concrete is commonly utilized to build structures due to fire-resistance benefits, insulating character, and mold-resistance. These products are commonly used in both outdoor structures and internal construction components. Additionally, these products may be painted, coated with substances like stucco and plaster, or utilized with siding materials. Structures that are made using traditional standard autoclaved aerated concrete blocks, however, may require the use of skilled craftsmen and do not provide sufficient insulation for colder climates.

Furthermore, modifications are commonly required for autoclaved aerated concrete blocks in order to accommodate electrical wiring, plumbing or other fixtures. In some instances, tradesmen may install a wood framing to the interior surface of the constructed autoclaved aerated blocks to provide a core for wiring installation. Furthermore, in colder climates and areas, the tradesmen may have to install insulative material to the exterior portions of the autoclaved aerated block structures in addition to the wood framing. This can be prohibitively expensive in several circumstances.

SUMMARY OF THE INVENTION

In view of the foregoing disadvantages inherent in the known types of insulating block systems now present in the prior art, the present invention provides an insulated fireproof concrete form system where the same can be utilized for providing convenience for the user when building a reinforced concrete structure.

The present system comprises a pair of autoclaved aerated concrete blocks. The autoclaved aerated concrete blocks are oriented entirely parallel to each other. Because of this orientation, a core is defined between the autoclaved aerated concrete blocks. An insulating block is disposed on an internal surface of each autoclaved aerated concrete block. Each insulating block is horizontally staggered so that a first end of the insulating block extends beyond a first end of the corresponding autoclaved aerated concrete block. As such, the system allows for interlocking of one block system to another. A plurality of rods is disposed across the core such as to hold the insulating blocks and autoclaved aerated concrete blocks together.

In one embodiment, it is an object of the present invention to provide insulating blocks that are vertically staggered relative to the autoclaved aerated concrete blocks. As such, the insulated fireproof concrete form systems will interconnect with one another.

In a further embodiment, it is an object of the present invention to provide a pair of pre-insulated blocks that are made of a polystyrene material. As such, the insulating blocks will be protected from fire by the pair of autoclaved aerated concrete blocks.

In yet another embodiment, it is an object of the present invention to provide at least one cavity disposed through the autoclaved aerated concrete blocks. As such, piping or wiring may extend through the insulated fireproof concrete form system.

In a further embodiment, it is an object of the present invention to provide a plurality of rods comprising a plurality of basalt ties. As such, the rods will be durable and non-conductive when used in structures constructed using the insulated fireproof concrete form system.

In another embodiment, it is an object of the present invention to provide a finger hold and alignment groove system upon the pair of autoclaved aerated concrete blocks. As such, the structural integrity of structures constructed using the insulated fireproof concrete form system is increased and can be dry-stacked.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
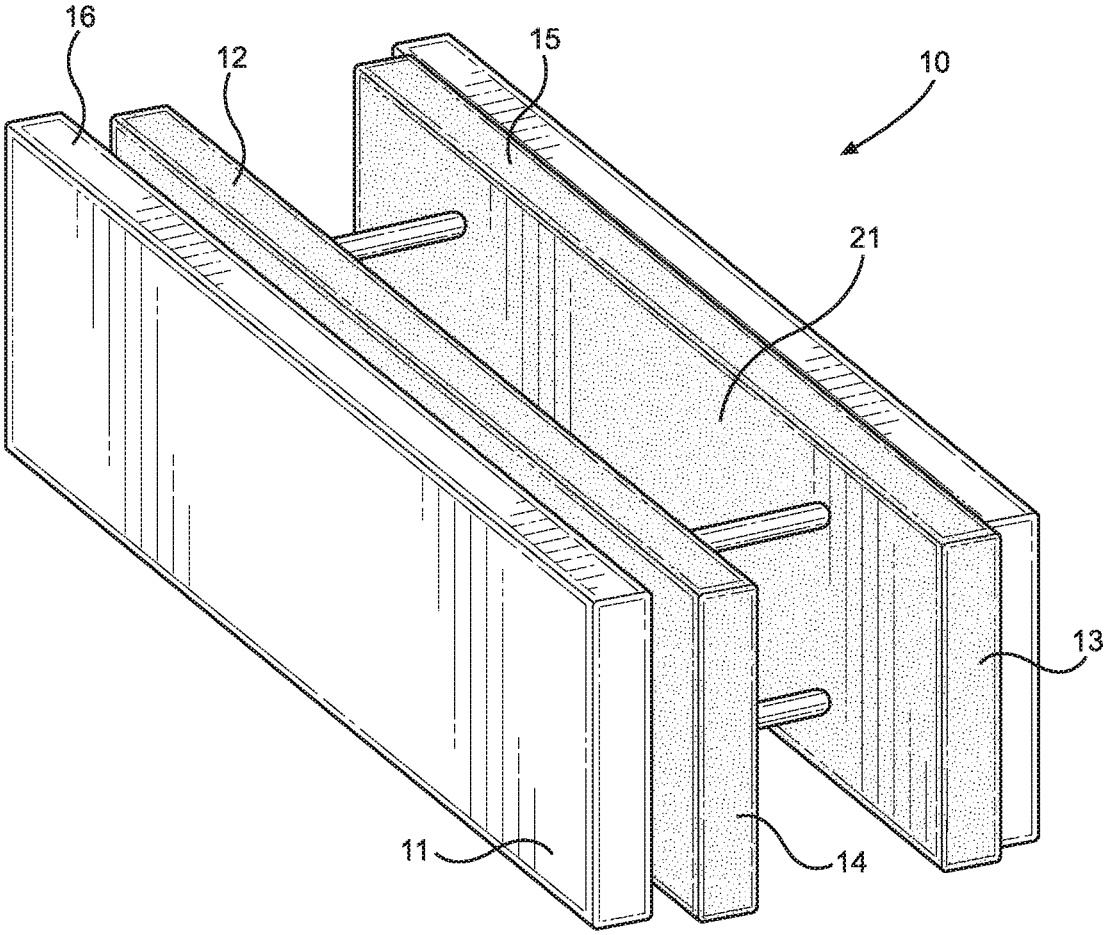
FIG. 1 shows an isometric view of an embodiment of the insulated fireproof concrete form system.

Reference is made herein to the attached drawings. Like reference numerals are used throughout the drawings to depict like or similar elements of the insulated fireproof concrete form system. The figures are intended for representative purposes only and should not be considered to be limiting in any respect.

Referring now to FIG. 1, there is shown an isometric view of an embodiment of the insulated fireproof concrete form system. The insulated fireproof concrete form system 10 comprises a pair of autoclaved aerated concrete blocks 11. Each autoclaved aerated concrete block of the pair of autoclaved aerated concrete blocks 11 is defined by a first end 14 disposed oppositely a second end 16. The pair of autoclaved aerated concrete blocks 11 are oriented entirely parallel to one another and define a core 21 therebetween. In the illustrated embodiment, each autoclaved aerated concrete block of the pair of autoclaved aerated concrete blocks 11 defines a length that is greater than a height defined by the autoclaved aerated concrete blocks 11. As such, the insulated fireproof concrete form system 10 can be utilized as a traditional brick or block that can be mortared together.

A pair of insulating blocks 12 are disposed on a pair of internal surfaces of the pair of autoclaved aerated concrete blocks 11. Each insulating block of the pair of insulating blocks 12 is defined by a first end 13 opposite of a second end 15. The pair of insulating blocks 12 are horizontally staggered relative to the pair of autoclaved aerated concrete blocks 11. As such, a first end 13 of each insulating block 12 extends beyond a corresponding first end 14 of each autoclaved aerated concrete block 11. In one embodiment, the pair of insulating blocks 12 are made of a polystyrene material. As such, the pair of insulating blocks 12 will be enclosed by the pair of autoclaved aerated concrete blocks 11, preventing off-gassing and rendering the insulated fireproof concrete form system 10 fireproof.

Figure 2:
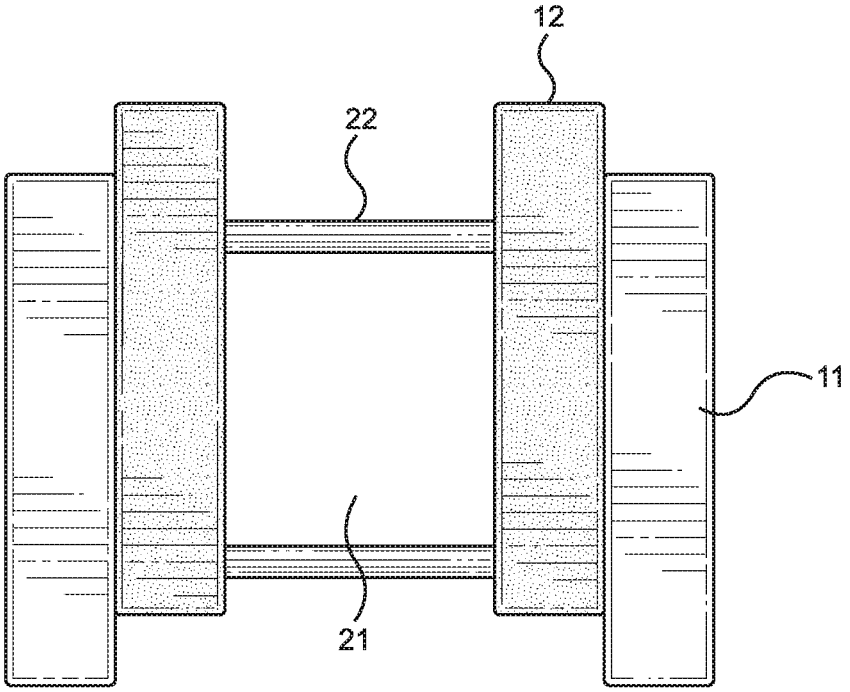
FIG. 2 shows a perspective view of an embodiment of the insulated fireproof concrete form system.

Referring now to FIG. 2, there is shown an end perspective view of an embodiment of the insulated fireproof concrete form system. The pair of autoclaved aerated concrete blocks 11 are parallelly oriented, such that a core 21 is defined between the pair of autoclaved aerated concrete blocks 11. The core 21 may be of any desired dimension as desired by the user. For example, for a larger structure, the user may desire that the core 21 be larger, such that more structural stability is provided, as a greater thickness of reinforced concrete can be poured therein.

A plurality of rods 22 are disposed between the pair of autoclaved aerated concrete blocks 11. The plurality of rods 22 extend through the pair of insulating blocks 12 into the pair of autoclaved aerated concrete blocks 11. The plurality of rods 22 provide structural stability to the insulated fireproof concrete form system and define the size of the core 21 between the pair of insulating blocks 12. In one embodiment, the plurality of rods 22 comprises a plurality of basalt ties. As such, the rods will be durable and non-conducting when used in structures constructed using the insulated fireproof concrete form system.

Figure 3:
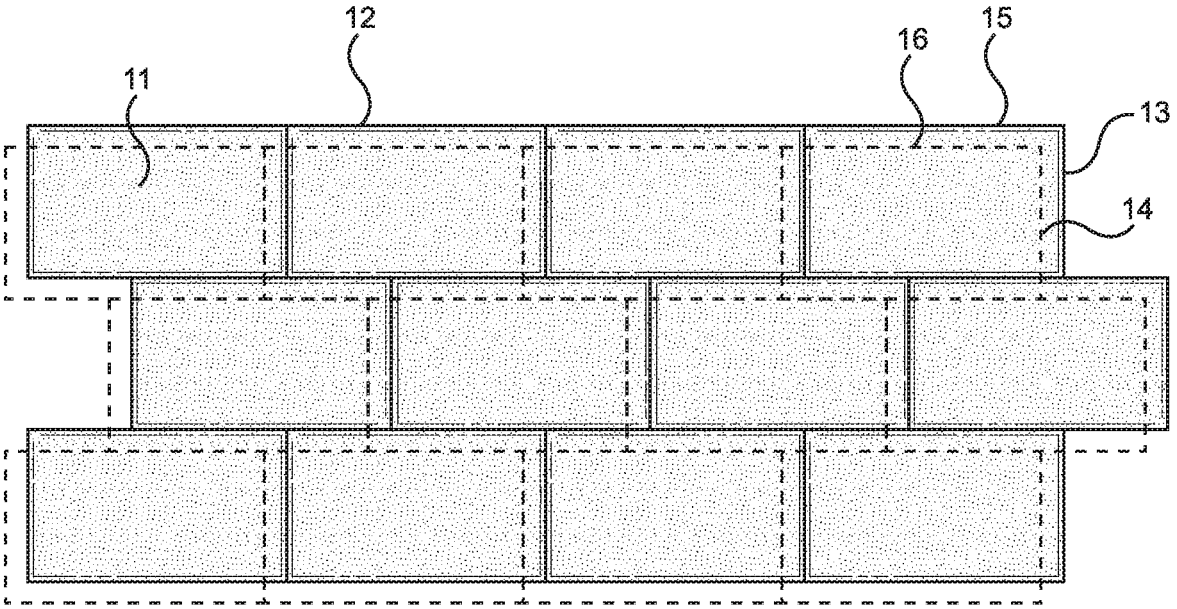
FIG. 3 shows a side perspective view of an embodiment of the insulated fireproof concrete form system.

Referring now to FIG. 3, there is shown a side view perspective of an embodiment of the insulated fireproof concrete form system as it will be constructed. As such the insulated fireproof concrete form system can be used to pour reinforced concrete walls. As viewed in FIG. 3, multiple insulated fireproof concrete forms are stacked to build a wall. Because the blocks are mortared with thin set cement there are no air gaps between the blocks. Thus, when poured, the concrete, or other building material, will not seep out of the structure.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulated fireproof concrete form system, comprising:

a pair of autoclaved aerated concrete blocks oriented entirely parallel and defining a core therebetween;

a pair of insulating blocks disposed on a pair of internal surfaces of the pair of autoclaved aerated concrete blocks;

the pair of insulating blocks being horizontally staggered such that a first end of each insulating block of the pair of insulating blocks extends beyond a first end of each autoclaved aerated concrete block of the pair of autoclaved aerated concrete blocks; and a plurality of rods connecting the pair of autoclaved aerated concrete blocks, the plurality of rods extending through each insulating block of the pair of insulating blocks, across the core formed thereby, and into the pair of autoclaved aerated concrete blocks.

2. The insulated fireproof concrete form system of claim 1, wherein the insulating blocks are vertically staggered, such that a top edge of each insulating block of the pair of insulating blocks extends above a top edge of each autoclaved aerated concrete block.

3. The insulated fireproof concrete form system of claim 1, wherein the pair of insulating blocks are made of an expanded polystyrene material.

4. The insulated fireproof concrete form system of claim 1, wherein the plurality of rods are basalt ties.

5. An insulated fireproof concrete form system, comprising:

a pair of autoclaved aerated concrete blocks oriented entirely parallel and defining a core therebetween;

a pair of insulating blocks disposed on a pair of internal surfaces of the pair of autoclaved aerated concrete blocks;

the pair of insulating blocks being horizontally staggered such that a first end of each insulating block of the pair of insulating blocks extends beyond a first end of each autoclaved aerated concrete block of the pair of autoclaved aerated concrete blocks; and a plurality of rods connecting the pair of autoclaved aerated concrete blocks, the plurality of rods extending through each insulating block of the pair of insulating blocks, across the core formed thereby, and into the pair of autoclaved aerated concrete blocks;

wherein the plurality of rods is made of a non-conductive material;

wherein the insulating blocks are vertically staggered, such that a top edge of each insulating block of the pair of insulating blocks extends above a top edge of each autoclaved aerated concrete block.

6. The insulated fireproof concrete form system of claim 1, wherein the core is of a uniform thickness across the entire area of the pair of insulating blocks.

* * * * *